United States Patent [19]

Hanselmann et al.

[11] Patent Number: 4,999,882

[45] Date of Patent: Mar. 19, 1991

[54] ADJUSTABLE GRID FOR FIBER BALE OPENER

[75] Inventors: Daniel Hanselmann; Walter Schlepfer, both of Winterthur, Switzerland

[73] Assignee: Maschinenfabrik Rieter AG, Winterthur, Switzerland

[21] Appl. No.: 365,524

[22] Filed: Jun. 13, 1989

[30] Foreign Application Priority Data

Jun. 15, 1988 [CH] Switzerland ..... 3820427

[51] Int. Cl.[5] ..... D01G 7/12

[52] U.S. Cl. ..... 19/80 R; 19/81

[58] Field of Search ..... 19/80 R, 80 A, 82, 85, 19/95; 74/570

[56] References Cited

U.S. PATENT DOCUMENTS

| | | | |
|---|---|---|---|
| 90,655 | 6/1869 | Fowler | 74/570 |
| 589,253 | 2/1898 | McKee | 74/570 |
| 2,067,399 | 1/1937 | Hughes | 74/570 |
| 3,381,341 | 5/1968 | Platt et al. | 19/80 R |
| 3,900,920 | 8/1975 | Whitehurst | 19/81 |
| 4,297,767 | 11/1981 | Leifeld | 19/80 R |
| 4,357,737 | 11/1982 | Marx | 19/80 R |
| 4,510,646 | 4/1986 | Locatelli et al. | 19/80 R |
| 4,586,217 | 5/1986 | Kranefeld et al. | 19/80 R |
| 4,623,099 | 11/1986 | Vosbein et al. | 241/101 A |
| 4,662,031 | 5/1987 | Feiks et al. | 19/80 R |
| 4,707,888 | 11/1987 | Binder et al. | 19/80 R |
| 4,748,725 | 6/1988 | Temburg et al. | 19/80 R |

FOREIGN PATENT DOCUMENTS

| | | |
|---|---|---|
| 2857520C2 | 2/1982 | Fed. Rep. of Germany . |
| 1191797 | 3/1959 | France . |
| 838793 | 6/1960 | United Kingdom . |
| 2100766 | 1/1983 | United Kingdom . |

*Primary Examiner*—Werner H. Schroeder
*Assistant Examiner*—Michael A. Neas
*Attorney, Agent, or Firm*—Burns, Doane, Swecker & Mathis

[57] ABSTRACT

The extraction arm of a fiber bale opening machine is provided with an adjustable grid made up of spaced apart grid bars between which driveable fiber removal members project to detach tufts of fiber from the bales. The depth of projection of the fiber removal members through the grid is adjustable by adjustment of the positions of the grid bars. The grid bars are mounted at their two ends on respective pivot spindles and at least one lever mechanism rotates a pivot shaft to move the pivot spindles up or down to lift or lower the grid bars. Also, the grid bars are restrained against undesired movements in the direction of their lengths by suitable stops or slots.

19 Claims, 8 Drawing Sheets

ADJUSTABLE GRID FOR FIBER BALE OPENER

FIELD OF THE INVENTION

This invention relates to bale opener apparatus suitable for removing tufts of fibers such as cotton from bales of compressed fiber. It is concerned particularly with an adjustable grid for the extraction arm of a bale opener machine, such adjustable grid permitting adjustment of the depth of projection into the bale of the driveable fiber extraction members which extend between the bars of the grid to pull fiber tufts from the bale.

BACKGROUND OF THE INVENTION

Bale openers having adjustable grids have been proposed heretofore in the European patent application having the publication number 199 041 and in the U.S. Pat. No. 3,381,341, for example. However, the construction and operation of such grids are subject to some disadvantages.

In conventional bale opener machines, the bales are disposed consecutively in a row parallel to the direction of movement of the bale opener extraction arm carrying the fiber extraction members (e.g. teeth) and the grid through which such members project to pull tufts of fiber from the bales while the arm is travelling along the row. The amount of protrusion of the fiber extraction members through the grid controls in general the rate at which fiber is removed from the bales. However, experience has shown that fiber density variations sometimes occur as between different bales as well as between different layers in a single bale. There are harder and softer bales, and in an individual bale the layer of fibers near the top is apt to be more open and less dense than a layer in the middle of the bale for example. This varying bale layer density affects the amount of fiber removed by the teeth and makes it desirable at times to change the depth of projection of the teeth through the grid.

The depth of projection is defined as the maximum distance which the fiber extraction members or teeth project beneath the grid which slides over the surface of the bales. It differs from the "feed depth," which represents a measure of the extent of vertical adjustment of the entire extraction arm of the bale opener after one transverse of the extraction arm has been completed and before its next movement along the row or group of bales has begun.

The mechanisms proposed heretofore for adjustment of the projection depth by adjusting the grid are relatively expensive. For example, U.S. Pat. No. 3,381,341 uses a plurality of bevel gears for adjustment of the grid, these being relatively expensive per se. To adjust the grid at its two ends, either an additional expensive gear system is required or two separate but suitably synchronized drive motors must be provided for the corresponding bevel gears disposed at the two ends of the grid. Moreover, adjustment of the grid inclination is not possible with such arrangements.

The arrangement shown in EP 199 041 allows adjustment both of the projection depth and of the grid inclination, but ultimately requires four drive motors which must be synchronized at least in pairs.

OBJECTS AND SUMMARY OF THE INVENTION

An object of the present invention is to provide a bale opener machine having an improved adjustable grid not subject to the disadvantages noted above.

A more particular object of this invention is to provide an adjustable grid which is inexpensive to manufacture, can be accurately adjusted, and is mechanically stable.

Yet another object of the invention is to obviate synchronization expenses through an adjustable grid that requires only one actuating motor or only one actuating motor on each side of the grid.

A still further object of the invention is to provide a bale opener grid so designed that adjustment of its angle of inclination with reference to the direction of traverse of the extraction arm is possible without appreciable additional costs.

An adjustable grid in accordance with the invention is formed by grid bars mounted at their two ends on associated first spindles extending transversely with respect to the longitudinal direction of movement of the extraction arm. At both the front and back of the arm, one lever mechanism is rotatable about a second spindle extending parallel to the first spindle to raise or lower the first spindle with the grid bar end portions carried thereby. Advantageously, the grid bars are supported against longitudinal displacement in the direction of traverse of the extraction arm.

The use of a lever mechanism means that the grid bars can be lifted or lowered at least at one end, so that the depth of projection can be adjusted. The rotary movement of the lever mechanism can be produced by a single actuating motor, the ends of all the grid bars being adjustable by substantially the same amount as a result of an operation of the motor.

In order to maintain the selected projection depth adjustment and avoid displacement of the grid bars horizontally during operation of the bale opener, the grid bars preferably are restrained by at least one vertical stop. One stop may be sufficient if fiber flocks or tufts are removed in only one direction of travel of the extraction arm. If, however, fiber flocks are removed in both directions of travel, the said horizontal displacement of the grid bars must be prevented in both directions by suitably arranged stops.

Since lifting or lowering just one end of the grid bars results in shortening of the horizontal distance between the two stops of the grid bars, the distance between the said stops can be made variable. However, this should not be necessary in instances where the shortening is practically negligible. In some embodiments, the grid bars are supported against longitudinal displacement at at least one end, i.e., they are so supported that the associated end is not displaceable in the longitudinal direction of movement of the extraction arm.

The lever mechanism may comprise a lever pivotally connected to a connecting link and fixedly connected to a pivot shaft. The connecting link is in turn pivotally connected to a pivot spindle pivotally carrying the grid bar ends. Independently operable lever mechanisms of this kind can be provided for both ends of the grid bars so that both ends can be lifted or lowered by the same or different amounts. Preferably, the lever mechanism comprises an eccentric drive, since in this way good lever action can be obtained in a space-saving arrangement of component parts.

In one simple embodiment, the eccentric drive may be an eccentric bush which extends through circular bores in adjacent ends of the grid bars. The projection depth can be adjusted by turning the eccentric bush by the action of an actuating motor if desired, in such manner that all the grid bars are adjusted by the same amount.

A preferable arrangement, however, is one in which it is not the grid bar end itself that is directly pivoted on the eccentric bush, but rather a lever which is in turn pivotally connected to a pivot spindle serving as a pivotal connection to the grid bar ends. Rotation of the eccentric bush may be accomplished by an activating lever which acts on either the eccentric bush or the pivot shaft to which the bush is fixed. An eccentric/-lever mechanism of this kind can also be used for both ends of grid bars. One advantage of this arrangement is that the space required for removal of the extracted fiber flocks in the peripheral zone of action of the rotatable fiber extraction teeth is less constricted by the lever mechanism than is the case in some other arrangements.

With the special arrangements discussed, it is preferable for at least the pivot spindle remote from the pivot shaft to be displaceable in guide slots of the extraction arm. A number of possibilities are available for the guide slots. They may extend horizontally or be inclined upwardly at an angle or have a curvature.

When the guide slots extend horizontally, adjustment of the liftable or lowerable ends of the grid bars by a vertical distance X results in a change of the projection depth of about X divided by 2 if the grid bars are disposed symmetrically. By the use of guide slots extending upwardly (or possibly downwardly) at an angle, the upward (or downward) movement of one of the grid bar ends by the lever mechanism will be accompanied by movement of the grid bars in a horizontal direction also, with the result that the opposite end of the grid bar will be raised (or lowered) as well. By the use of curved guide slots, it is even possible to ensure that the two ends of the grid bars are raised or lowered by exactly the same amounts.

Another possible arrangement for ensuring the required displaceability of the grid bars is to provide a second pivot spindle which extends parallel to the first pivot spindle at a location spaced from the pivot shaft. This second pivot spindle is connected to the first pivot spindle via at least two pivotal connecting links spaced apart from one another along the length of the pivot spindles. In a preferred arrangement of this kind, the two connecting links are constructed to correspond to an additional connecting link extending between the pivot shaft and the first pivot spindle.

In one form eccentrics are disposed on the pivot shaft. In order that the mechanical arrangements at the left-hand and right-hand ends of the grid bars may be identical, eccentrics may be disposed on pivot shafts at both ends of the bars and actuating levers may be provided for both of them.

With such a construction the spindles connected to the ends of the grid bars should be guided in guide slots extending at least substantially vertically in order to limit the horizontal displaceability of the grid bars. These guide slots must, however, be somewhat wider in the horizontal direction than the diameters of the spindles in order to allow for the longitudinal movement of the grid bars imposed by the eccentrics or lever action.

A particularly preferred arrangement of this kind is one in which the pivot shafts have a greater distance from one another than the pivot spindles and are disposed above the pivot spindles. As a result, the space below the conventionally rotatable fiber extraction means is optimally adjusted to the turning circle of these means, so that the mechanical arrangements do not restrict the space available for removal of the fiber flocks.

In an arrangement with a lever mechanism at both ends of the grid bars, it is possible so to adjust the grid bars that a positive angle of incidence is available in each direction of travel of the opener along the row of bales. This greatly facilitates sliding of the grid bars over the bales during traverse of the extraction arm.

Each actuating lever is preferably activated by a motor and movable between two positions at which switches are provided which stop the motor and limit the lever travel. Even if two actuating levers are used (i.e., one for each of two actuating motors for the two sides of the adjustable grid), synchronization of the two motors is not necessary.

The drive provided for each actuating lever is preferably so designed that it is not reversible by pressure applied to the grid bars. For example, it is possible to use a rotary screw drive which acts on the actuating lever via a nut. This prevents the projection depth from being changed by pressure applied to the grid bars.

The grid bars themselves preferably have integrated spacers at their ends, the spacers being mounted directly side by side depending upon the arrangement of the grid bars on the pivot spindles. This obviates loose spacers and the arrangement consists of a large number of identically constructed grid bars which can then be made inexpensively, preferably as aluminum castings, e.g., aluminum die castings.

The size of the spacers should be such that the distance between adjacent grid bars is somewhat larger than the amplitude of the preferably swashplate-like movement of the fiber extraction means. In side elevation the grid bars can also be inclined upwardly somewhat at the ends so that they operate as a kind of skid for both directions of movement of the extraction arm.

In the case of extraction arms of conventional lengths it is sufficient to provide one actuating lever for each side of the grid, the actuating lever preferably being disposed in the middle of the extraction arm so that it is possible to limit to a minimum any inaccuracies due to twisting of the second or third spindles. Finally, each eccentric may have a slot and be fixed to the pivot shaft or second pivot spindle via a clamping screw.

BRIEF DESCRIPTION OF THE DRAWINGS

These and other features and advantages of the invention will be understood more fully by considering the explanations given below with reference to exemplary embodiments depicted in the drawings, wherein.

DETAILED DESCRIPTION OF PREFERRED EMBODIMENTS

Figure 1:
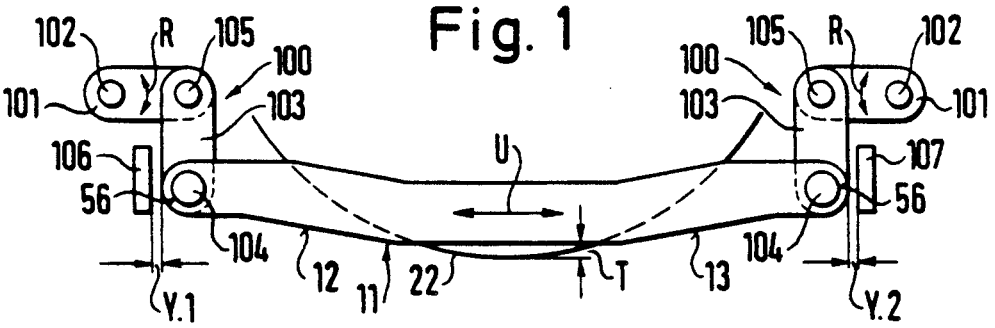
FIG. 1 is a side elevation of an embodiment of a single grid bar mounted for adjustment in accordance with the present invention.

FIG. 1 shows an individual grid bar 11 movably supported at each end by a lever mechanism 100 comprising a lever 101 fixed on a pivot shaft 102 and a connecting link 103. One end of the connecting link 103 is pivotally connected to a first pivot spindle 104 and the other end is pivotally connected to a second pivot spindle 105. The first pivot spindle 104 provides a pivot support for an end of each of the grid bars 11. The second pivot spindle 105 is the means by which the lever 101 and the connecting link 103 are pivotally interconnected.

Each of the pivot shafts 102 is mounted in an extraction arm 16 (to be described in detail hereinafter) of a bale opener machine so as to be driveable and rotatable as indicated at R. It is preferred that the levers 101 extend substantially horizontally from the shafts 102, when looking at FIG. 1, and that the connecting links 103 be disposed substantially vertically. However, an inclined arrangement could satisfy some of the same purposes but with different force ratios.

During traversing of the bale opener extraction head along a row of fiber bales, the grid formed by bars 11 will contact the fibers of the bales and drag forces will be developed tending to shift the grid bars 11 in the horizontal direction U. In order to prevent such shifting of the grid bars 11, stops 106 and 107 are fixed on the extraction arm in position to limit the possibilities for horizontal movements of the bars. Each of these stops may extend continuously over the entire length of an extraction arm, or individual stops of limited length may be distributed along the arm. In any event, such stops should be effective at least with respect to the outermost grid bars of a grid in accordance with the invention. The clearances Y.1 and Y.2 shown in FIG. 1 between the ends of the grid bars and the stops 106 and 107 should only be such that the grid bars are satisfactorily guided. It is not desirable that the bars be clamped between the stops.

When it is desired to change the positions of the grid bars 11 during operation of the bale opener, the pivot shafts 102 are rotated to swing the levers 101 in the direction R, so that the grid bars will be either raised or lowered. The two pivot shafts preferably are rotatable independently of one another to permit one of the levers 101 to be pivoted more than the other one when this is desired. When for example, the lever 101 on one side is pivoted more (or in a different direction) than the lever on the other side, one end of the grid bars 11 will be higher than the other. This also causes slight changes in the clearances Y.1 and Y.2, but such changes ordinarily are practically negligible.

As will also be seen from FIG. 1, the individual grid bars 11 have upwardly inclined zones 12 and 13 at their ends. Each of these inclined zones may function as a kind of skid in operation, to ensure sliding of the grid along the row of bales. The presence of two of the zones 12 and 13 facilitates this sliding movement in both directions of traverse of the extraction arm.

Figure 2:
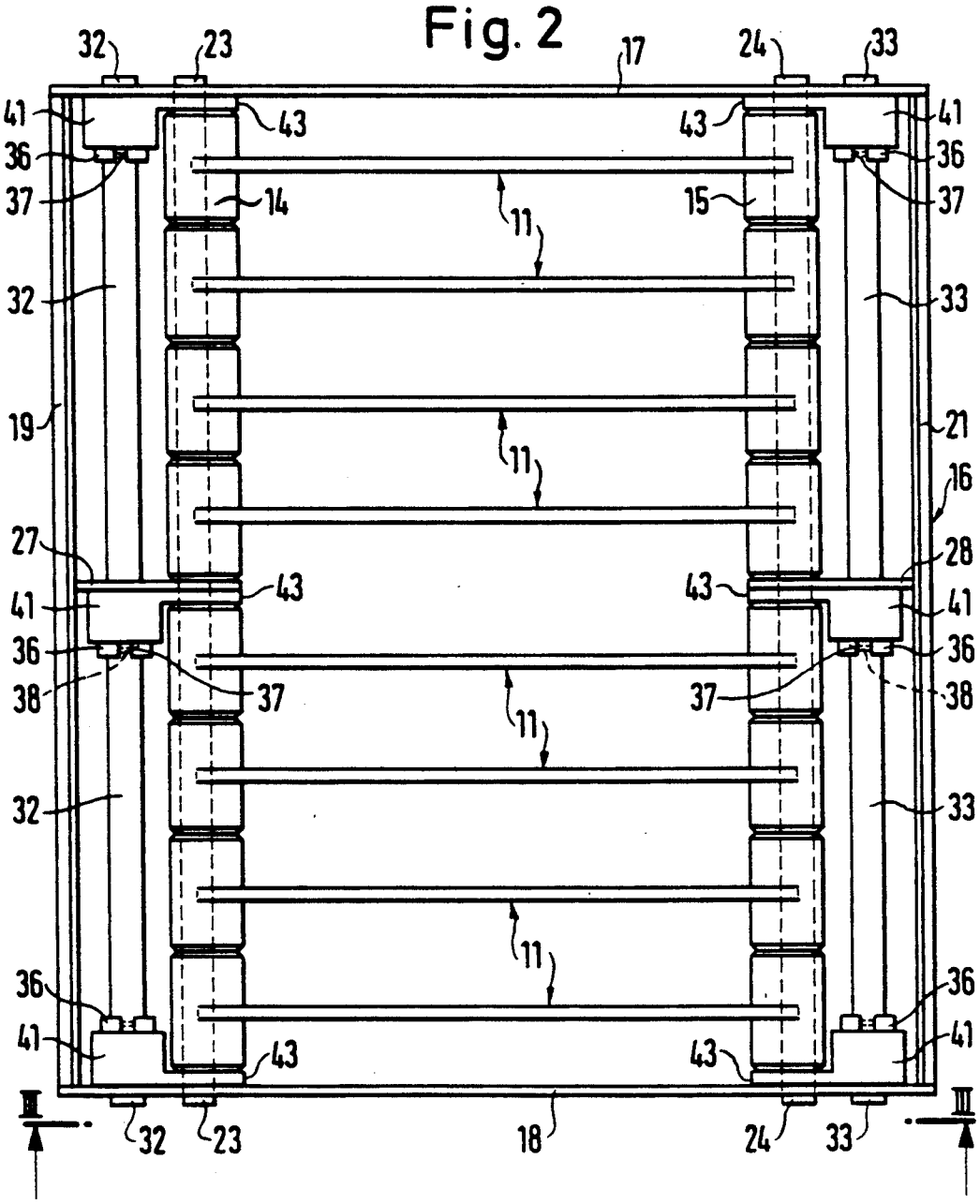
FIG. 2 is a plan view of an extraction arm of a bale opener provided with an adjustable grid in accordance with another embodiment of the invention, the rotary toothed fiber extraction components having been omitted for the sake of clarity and the extraction arm being shown in a shortened form.

The grid bars 11 preferably are aluminum die-castings provided with integrated spacers 14 and 15 (FIG. 2) at their ends so that, on installation in an extraction arm 16, as shown in FIG. 2, the grid bars can be disposed immediately adjacent one another without any intermediate elements being necessary.

FIG. 2 shows a particularly preferred lever mechanism illustrated in greater detail in FIGS. 4–7. The extraction arm 16 of FIG. 2 is provided with only eight grid bars 11, but it should be understood that in practice there are many more, the number having been reduced here for the sake of clarity.

Figure 3:
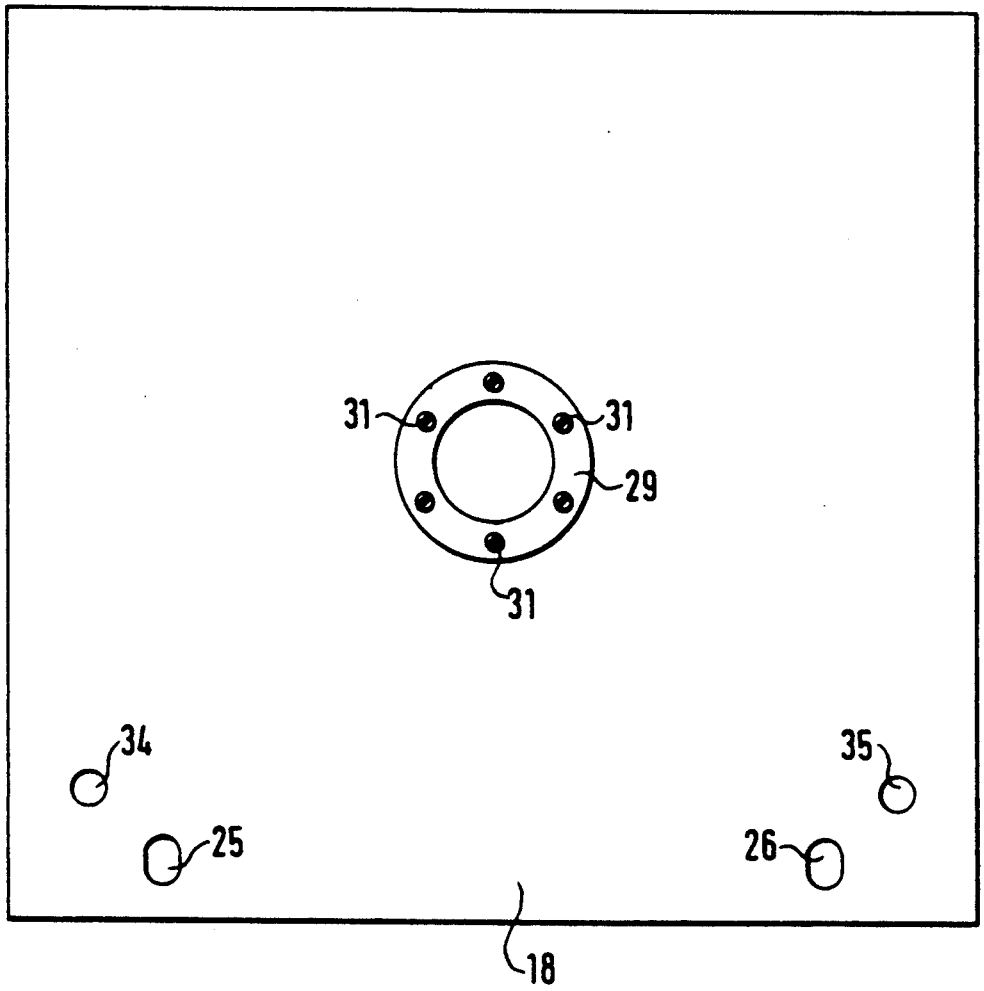
FIG. 3 is an end elevation of the bale extraction arm in the direction of the arrows III—III in FIG. 2.

At its top end in FIG. 2, the extraction arm 16 has a continuous plate 17, which is adapted to be fixed to the tower of a bale opener machine. At its bottom end in FIG. 2, the extraction arm 16 has a plate 18 which is visible in FIG. 3. Plate 18 and plate 17 are interconnected via frame parts 19 and 21 to form a generally rectangular rigid frame. Inside this frame, a support shaft extends between the plates 17 and 18 and carries fiber extraction members arranged swashplate fashion. These members are not visible in FIG. 2 of the drawing but they are known per se from the European patent application having the publication number 199 041. The end elevation in FIG. 3 shows, in the middle, a bearing housing 29 for the shaft for the fiber extraction members, the housing being secured to the plate 18 by screws 31. Another bearing can be provided on plate 17.

The circles of revolution of the swashplate-like fiber extraction members are shown in FIGS. 4–7 at reference numeral 22. The arrangement is such that a member in the form of a swashplate is situated between adjacent ones of the grid bars 11 so that the working points or teeth at its periphery protrude beneath the undersides of the grid bars. The distance between the lowermost positions of such points and the undersides of the grid bars is designated the projection depth T. In operation it is desirable to adjust this projection depth T between two values, $T_{min}-T_{max}$ (see for example FIG. 4), the difference $T_{min}-T_{max}$ being about 7 millimeters.

The object of the arrangement described above is to permit simultaneous adjustment of the depth of projection for all the bars of the grid by the same amount. To this end, two pivot spindles 23 and 24 extend through the bores at the two ends of the grid bars. The pivot spindles 23 and 24 extend across the carrier or extraction arm 16 and pass through the end plates 17 and 18 which close the extraction arm 16 at the opposite ends. The openings in the extraction arm end plates 17 and 18 for receiving the pivot spindles 23 and 24 are formed as guide slots 25 and 26 as will be seen from FIG. 3. To avoid sagging of the pivot spindles, supports 27 and 28 are attached on the left and right sides of the extraction arm in FIG. 2 at the associated frame parts 19 and 21.

The guide slots 25 and 26 are made somewhat wider than the diameter of the pivot spindles 23 and 24 in order that they may have sufficient width even when the grid bars 11 are raised or lowered as described hereinbefore without maintaining the horizontal position. In respect of length, these slots are made sufficiently long for the required range of adjustment of the projection depth to be possible.

For moving the grid bars, first and second pivot shafts 32 and 33 are mounted to rotate in bearing bores 34 and 35 of the end plate 18 and in corresponding bearing bores disposed in the end plate 17 and in the two supports 27 and 28. Three eccentric bushes 36 of identical construction are clamped on the first pivot shaft 32, for which purpose each eccentric bush has a slot 37 and a clamping screw 38 extends through the material on both sides of the slot 37 so that tightening of the screw will clamp the eccentric bush o its shaft.

Three eccentric bushes 36 of identical construction are also clamped on the second pivot shaft 33. Levers 41 also are disposed pivotally on the cylindrical outer surfaces 39 of these eccentrics, the arrangement being a mirror-image of that on the other side of the extraction arm. The pivotability of the levers 41 is obtained by means of a first cylindrical bore 42 which is mounted rotatably on the cylindrical surface 39 of the associated eccentric 36. At their ends 43 remote from the bores 42 the levers 41 have a second cylindrical bore 44 in which the pivot spindles 23 and 24 are pivotally mounted. These bores 44 are of exactly the same dimensions as the cylindrical bores 56 (FIG. 1) in the two ends of the grid bars 11. It will be seen from FIGS. 4 to 7 that the eccentric bushes 36 have a bore 45 eccentric in relation to their cylindrical outer surfaces 39, through which bore the first pivot shaft 32 and the second pivot shaft 33 respectively extend.

It will be seen from FIG. 2 that the first cylindrical bores 42 of the levers 41 have a considerable length. This construction was selected to obviate jamming of the levers on the cylindrical surface of the associated eccentrics. It will immediately be apparent that all the levers, all the eccentric bushes, and all the grid bars, whether on the left or right of the axis of symmetry of the extraction arm, are of identical construction.

Figure 7:
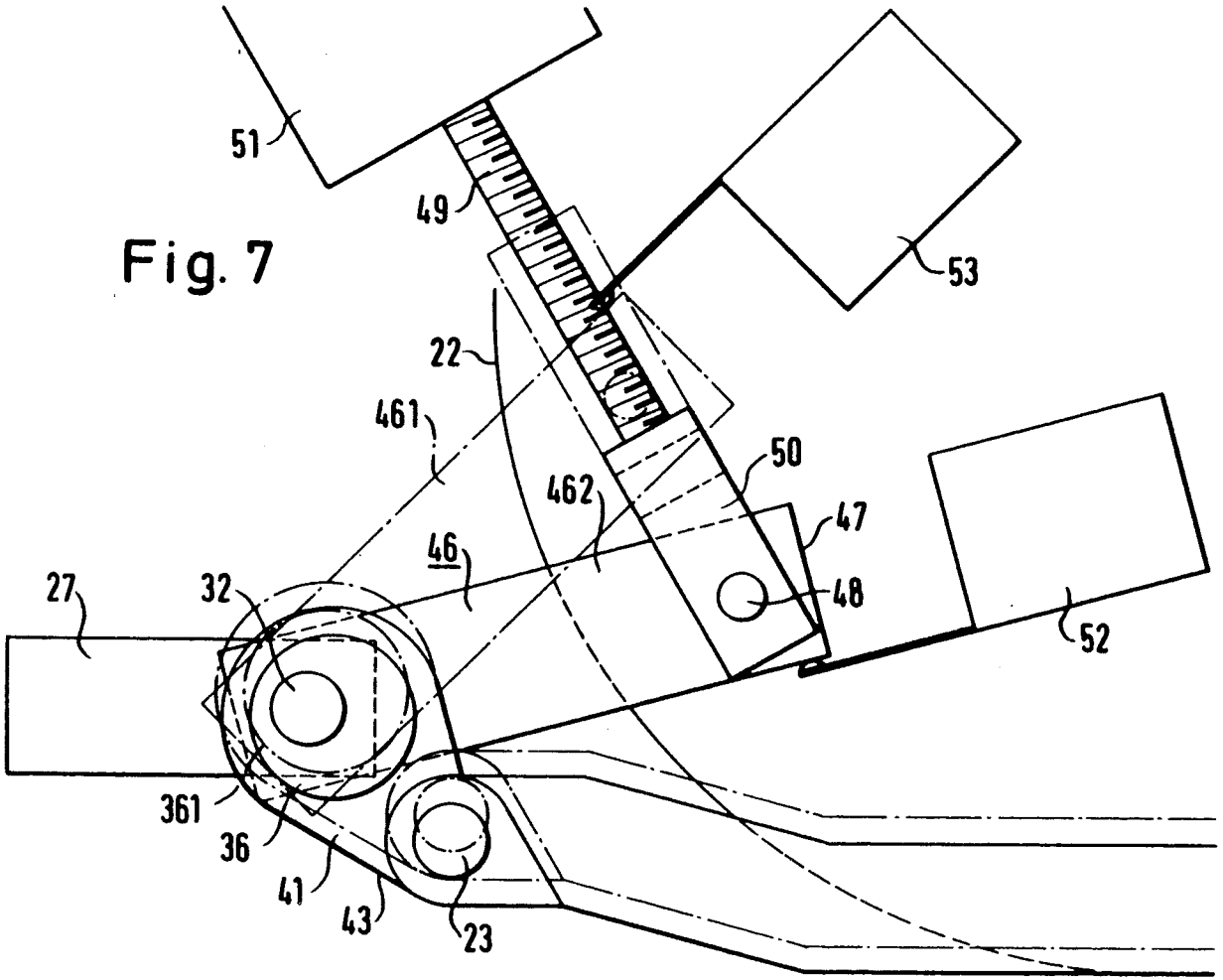
FIG. 7 is a side elevation of the left-hand end of a single grid bar showing an actuating mechanisms for adjusting the grid bar.

Adjustment of the grid bars via the levers 41 is effected by means of actuating levers 46 (FIG. 7) disposed on the pivot shafts 32 and 33 so as to rotate therewith. The free end 47 of each actuating lever 46 remote from the eccentric bush 36 is pivotally connected via a pivot 48 to an internally screwthreaded joint part 50, the latter receiving a screwthreaded rod 49 which is at the same time the shaft of an electric motor 51. Operation of the motor 51 causes the part 50 to be moved away from or towards the stationary motor 51 by means of the rod 49. Two limit switches 52 and 53 are also provided which, in the two end positions 461 and 462 of the actuating lever 46, are actuated by the latter and break the current supply to the electric motor 51. FIG. 7 simply shows the arrangement on the left-hand side of the extraction arm 16 in FIG. 2. An identical arrangement is also provided o the right-hand side.

In practice it may be desirable in some instances to provide for programmed control over the operation of the motors 51 which provide the drive for adjusting the position of the grid of the bale opener machine. For example, the layers of fiber at the center of a cotton bale are more densely packed than those at the top of the bale and changes in the projection depth of the fiber engaging instrumentalities or teeth in the traverse arm mechanism may be advantageous in connection with such density changes.

Figure 13:
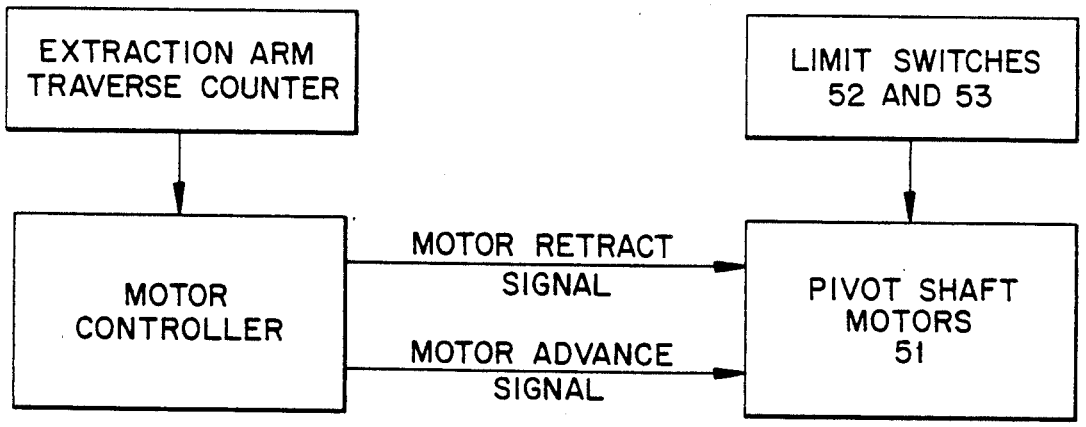
FIG. 13 is a diagram depicting a control arrangement wherein automatic adjustment of the adjustable grid of a bale opener is accomplished in accordance with an aspect of the invention.

Referring to FIG. 13, a control system for accomplishing such adjustments includes an Extraction Arm Traverse Counter which is programmed to accumulate a count of the number of traverses of the bale opener extraction arm past the bales being opened, beginning from a time when a set of full bales first is acted upon. At the end of each traverse, the traverse arm is moved down a step so that on its next traverse fiber at a lower level in the bales will be engaged by the teeth for removal of tufts or flocks. After a predetermined number of traverses has taken place, it can be judged that the arm has reached a level where adjustment of the projection depth would be worthwhile and a signal may be sent to a Motor Controller operatively connected to both the Extraction Arm Traverse Counter and the pivot shaft motors 51 and 52.

The Motor Controller may first send a Motor Advance Signal to cause operation of the motors 51 and 52 in one direction until one of the limit switches 52 or 53 is actuated. The resulting change in the position of the grid relative to paths of the fiber engaging teeth in the extraction arm may promote more effective bale opener operation for the particularly dense zones within the bales. At a later time, when a higher count has been accumulated by the Extraction Arm Traverse Counter, a Motor Retract Signal may be sent to the motors 51 and 52 to cause the motors to run in the opposite directions to restore the projection depth of the fiber engaging teeth to its initial value.

Of course, more elaborate adjustment programs for controlling the motors 51 can readily be devised to meet particular needs. In general an adjustment range of about ten millimeters will be appropriate for cotton bale openers, and it will ordinarily be preferred that the system provide for stepless adjustment of whatever amounts may be appropriate.

Figure 4:
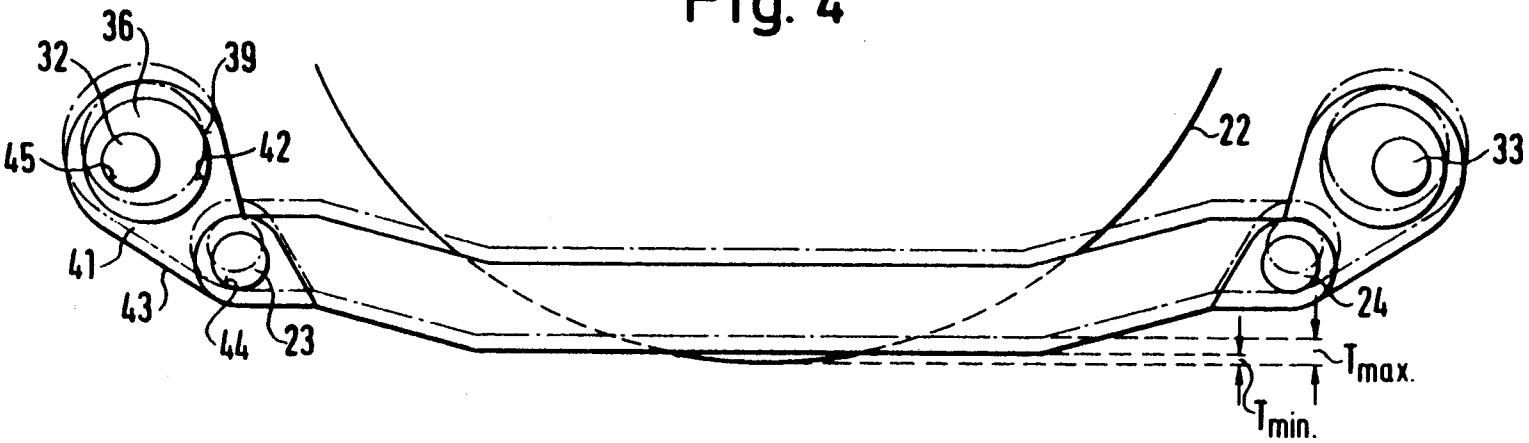
FIG. 4 is a side elevation of a grid bar of the grid of FIG. 2, showing the adjustment features provided for this grid bar.

As will be seen particularly from FIGS. 4 and 7, movement of one of the actuating levers 46 results in rotation of its pivot shaft 32 or 33 and hence rotation of the two eccentric bushes 36 thereon at the ends of the extraction arm 16. This rotation of the eccentric bushes results in an end 43 of the lever 41 being lifted and, by way of the pivot 23, lifting of the left-hand ends of the grid bars 11 in FIG. 4.

FIG. 4 contemplates the simultaneous adjustment of the two ends of the grid bars 11 by motors 51 on the left and right of the extraction arm 16 so that the depth of projection can be varied between $T_{min}$ and $T_{max}$. Intermediate positions are also possible.

Figure 5:
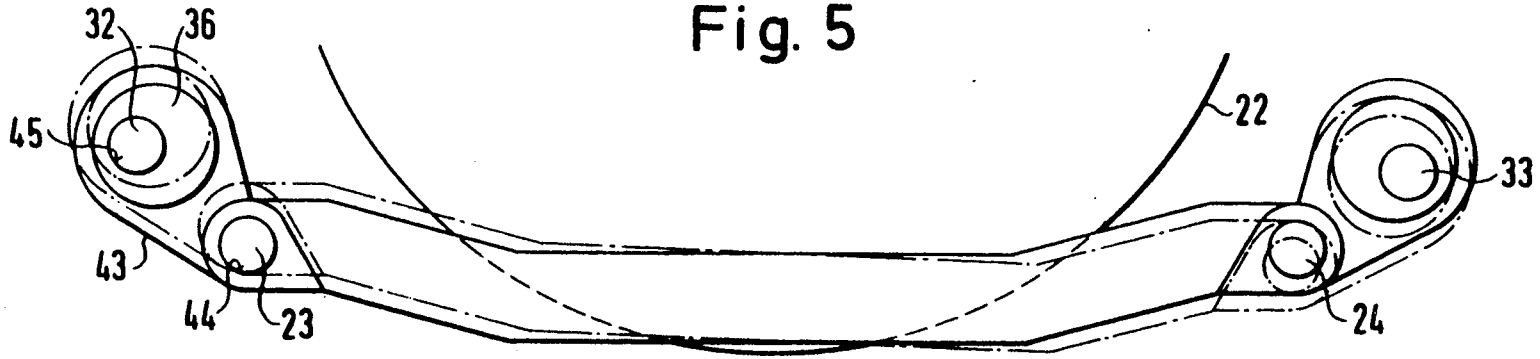
FIG. 5 is a similar side elevation to FIG. 4 but showing how the angle of incidence of the grid bar may be changed.

FIG. 5 shows that different adjustments of the left-hand and right-hand ends of the grid bars 11 are possible by appropriate control of the associated motors 51, the angle of incidence of the grid bars 11 being variable and, if required, without simultaneous adjustment of the mean projection depth. The possibility of changing the angle of incidence of the grid bars is particularly advantageous since this can increase the skid action of the grid bars.

Figure 6:
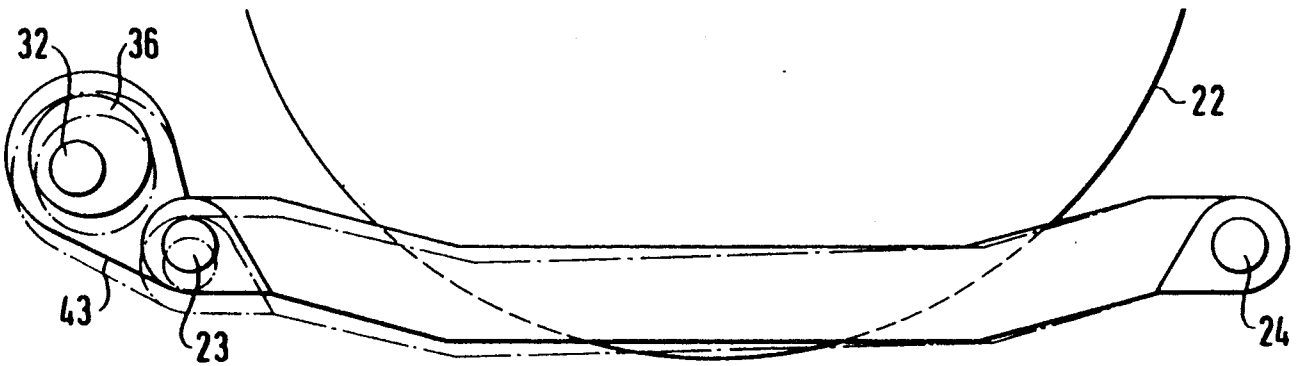
FIG. 6 is a side elevation of a grid bar in a somewhat modified embodiment.

As shown in FIG. 6, it is not always absolutely necessary to adjust the two ends of the grid bars in order to change the projection depth. Instead, the right-hand end of the grid bar 11 in FIG. 6 can simply be pivoted to the pivot spindle 24, it being unnecessary in this case to provide displaceability of the spindle 24. Although the change of the angle of incidence of the grid which can be obtained by moving the left-hand end of the grid bar is limited, this need not necessarily be a disadvantage, for example in the case of a bale opening machine which always extracts material in the same direction.

Figure 8:
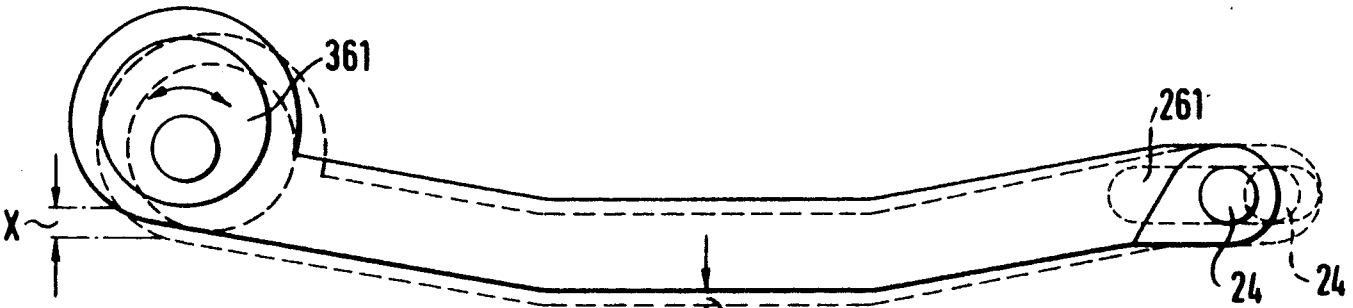
FIG. 8 is a side elevation of a grid bar of another embodiment of the invention.
Figure 9:
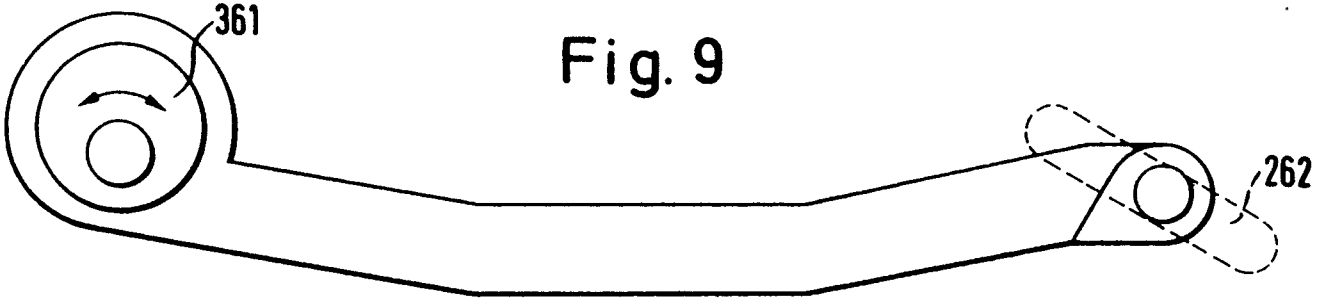
FIG. 9 is a side elevation corresponding to FIG. 8 but of a somewhat modified embodiment.
Figure 10:
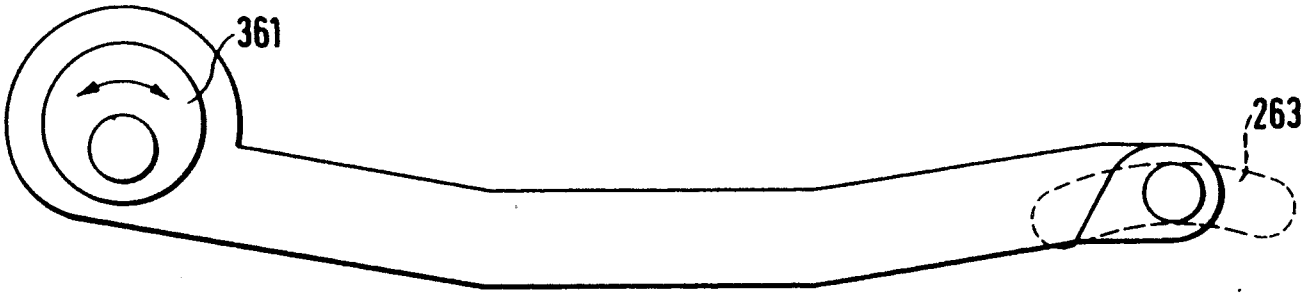
FIG. 10 is a side elevation corresponding to FIGS. 8 and 9 but with a further modification.

Alternatively it is possible to adjust the two ends of the grid bars 11 by means of just one actuating motor. The embodiments according to FIGS. 8, 9 and 10 show this. It must initially be stated that in the different embodiments in FIGS. 8, 9 and 10 the spindles are guided in elongate slots 261, 262 and 263 which are provided in the end plates 17 and 18 and the support 28. In this arrangement the eccentric bushes are disposed in a different angular position so that turning the eccentric bush 361 results in a marked displacement of the grid bars 22 in their longitudinal direction. This will be seen particularly from FIG. 8, in which the relative displacement of the spindle 24 is shown for half an adjustment movement of the eccentric 361. This large displacement movement of the grid bars can now be utilized, by the use of an inclined slot guide 262 as shown in FIG. 10, for the purpose of lifting or lowering the right-hand end of the grid bar and hence the grid.

Figure 11:
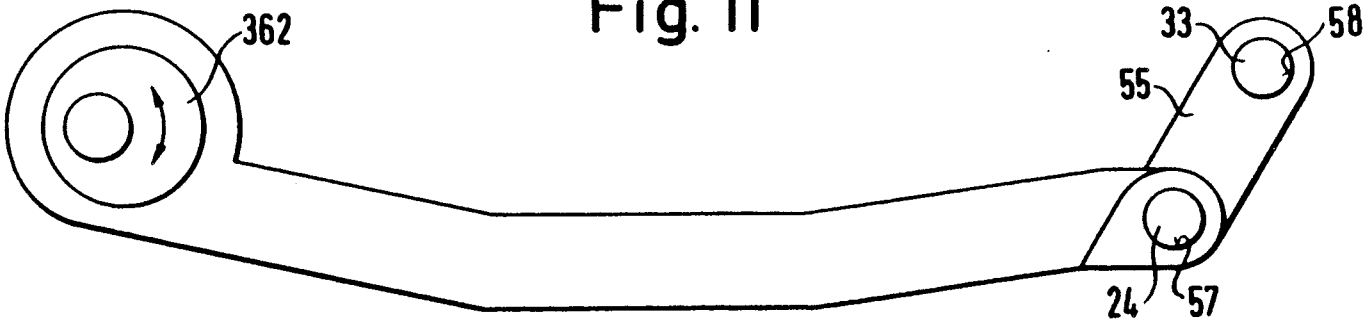
FIG. 11 is a side elevation of a bar of an adjustable grid of still another embodiment of the invention.

FIG. 11 shows another somewhat modified embodiment in which the eccentric bush 362 again has the rotary position of the eccentric bush 36 of FIGS. 1 to 7 but the right-hand end of the grid bar is pivoted to a connecting link 55, the connecting link 55 having bores 57 and 58 at its two ends. The pivot spindle 24 is rotatably received in the bore 57 and the second pivot shaft is rotatably received in the bore 58. In this embodiment the guide slots 25 and 26 are not required.

Figure 12:
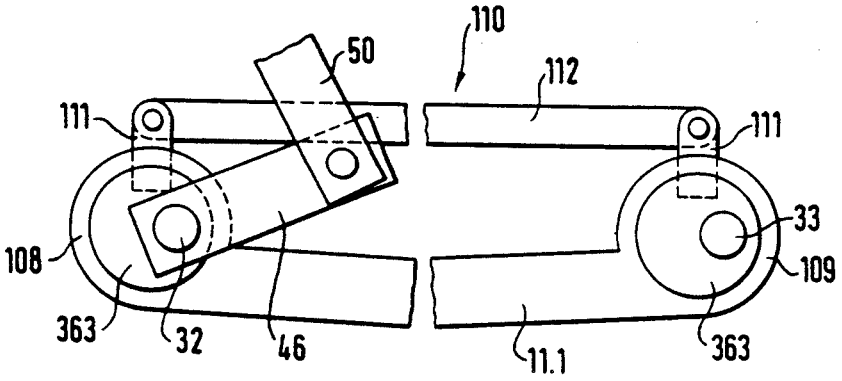
FIG. 12 is a side elevation of a grid bar of yet another embodiment having some features of the invention.

FIG. 12 shows another variant in which an eccentric bush 363 is provided in the two ends of a correspondingly adapted grid bar 11.1. In this case the eccentric bushes are fixedly connected to the first pivot shaft 32 at the left-hand end 108 of the grid bar 11.1 in FIG. 12, while they are fixedly connected to the second pivot shaft 33 at the right-hand end 109. The two eccentric bushes 363 are also interconnected by an overdrive 110, which consists basically of a crank lever 111 secured to each eccentric bush 363, the crank levers 111 being pivotally connected to a connecting link 112. Accordingly, all that is required is to drive one of the two pivot shafts 32 and 33 by an actuating lever 46 such as described above.

To enable the overdrive 110 to act in a favorable power ratio, the crank levers 111 are offset by an angle of about 90° to the pivot shafts 32 and 33. Also, the eccentric bushes 363 are not arranged in mirror-image fashion as shown in FIGS. 4 and 5, but are disposed in the same directions so as to enable the grid bars 11.1 to be uniformly lowered or lifted at both ends.

Of course here again, it is possible to dispose the crank levers in a different position in the associated eccentric bushes at the left-hand and right-hand ends of the grid bars 11.1 so that, for example, the right-hand end 109 is lower than the left-hand end 108 or vice versa. For this purpose all that is necessary is for one of the two crank levers 111 to be arranged displaceably and lockably on the associated eccentric bush, and this can be achieved, for example, by an annular guide groove (not shown) in the cross-sectional surface of the eccentric bus 363 in which the corresponding crank lever 111 is guided and lockable.

Other modifications and variations will suggest themselves to persons skilled in the art.

Although various embodiments of the invention have been described in detail, such is intended to be exemplary only, and the scope of the invention is to be ascertained from the following claims.

What is claimed is:

1. An extraction arm for a fiber bale opening machine of the type which includes a grid for contacting a surface of the bale while tufts of fiber are being pulled from the bale for processing, said extraction arm including frame means; a pivot shaft carried by said frame means for angular pivoting movement about the longitudinal axis of said pivot shaft; a plurality of grid bars spaced apart from one another along the length of said pivot shaft with each of said grid bars extending away from said pivot shaft; means operatively connected to an end of each of said grid bars and to said pivot shaft in a manner such that angular motion of said pivot shaft about its longitudinal axis is accompanied by movement of each of said grid bars relative to said frame means; and means for angularly pivoting said pivot shaft to adjust the positions of said grid bars.

2. An extraction arm for a fiber bale opening machine according to claim 1, wherein said means operatively connected to said end of each of said grid bars and to said pivot shaft includes eccentric means fixed on said pivot shaft.

3. An extraction arm for a fiber bale opening machine according to claim 2, wherein said means operatively connected to said end of each of said grid bars and to said pivot shaft additionally includes lever means having at one end thereof an opening surrounding and being freely movable about said eccentric means, said end of said grid bars being pivotally connected to the opposite end of said lever means; and wherein said extraction arm additionally comprises stationary means on said frame means for limiting endwise movement of said grid bars in a direction parallel to the lengthwise extent of said grid bars.

4. An extraction arm for a fiber bale opening machine according to claim 2, including a pivot spindle having the opposite ends of said grid bars pivotally mounted thereon, said pivot spindle being operatively connected to said frame means.

5. An extraction arm for a fiber bale opening machine according to claim 4, wherein said frame means includes first and second end members having matching slots therein for receiving said pivot spindle.

6. An extraction arm for a fiber bale opening machine of the type which includes a grid for contacting a surface of the bale while tufts of fiber are being pulled from the bale for processing, said extraction arm including frame means; a pivot shaft carried by said frame means for angular pivoting movement about the longitudinal axis of said pivot shaft; a plurality of grid bars spaced apart from one another along the length of said pivot shaft with of each of said grid bars extending away from said pivot shaft; means operatively connected to an end of each of said grid bars and to said pivot shaft in a manner such that angular motion of said pivot shaft about its longitudinal axis is accompanied by movement of each of said grid bars relative to said frame means, said means operatively connected to said end of each of said grid bars and to said pivot shaft including eccentric means fixed on said pivot shaft; a pivot spindle having the opposite ends of said grid bars pivotally mounted thereon and said frame means including first and second end members having matching slots therein for receiving said pivot spindle and being inclined so that endwise movement of said grid bars in response to rotary movement of said eccentric means results in elevation or lowering of said grid bars; and means for angularly pivoting said pivot shaft to adjust the positions of said grid bars.

7. An extraction arm for a fiber bale opening machine according to claim 1, wherein said means operatively connected to said end of each of said grid bars and to said pivot shaft includes a plurality of levers fixed to said pivot shaft at intervals along the length of said pivot shaft, each of said levers projecting from said pivot shaft in a direction generally corresponding to the lengthwise extent of said grid bars; and a plurality of links each pivotally connected at one of its ends to said end of a grid bar and at its other end to an end of one of said levers remote from said pivot shaft.

8. An extraction arm for a fiber bale opening machine according to claim 7, additionally including stop means on said frame means for limiting movement of said grid bars in a direction parallel to the lengthwise extent of said grid bars.

9. An extraction arm for a fiber bale opening machine according to claim 1, additionally comprising a second pivot shaft mounted on said frame means for angular pivoting movement about its longitudinal axis; and second means operatively connected to said second pivot shaft and to the opposite ends of said grid bars in a manner such that angular motion of said second pivot shaft about its longitudinal axis is accompanied by movement of said opposite ends of said grid bars.

10. An extraction arm for a fiber bale opening machine of the type which includes a grid for contacting a surface of the bale while tufts of fiber are being pulled from the bale for processing, said extraction arm including frame means; a pivot shaft carried by said frame means for angular pivoting movement about the longitudinal axis of said pivot shaft; a plurality of grid bars spaced apart from one another along the length of said pivot shaft with each of said grid bars extending away from said pivot shaft; means operatively connected to an end of each of said grid bars and to said pivot shaft in a manner such that angular motion of said pivot shaft about its longitudinal axis is accompanied by movement of each of said grid bars relative to said frame means; means for angularly pivoting said pivot shaft to adjust the positions of said grid bars; a send pivot shaft mounted on said frame means for angular pivoting movement about its longitudinal axis; second means operatively connected to said second pivot shaft and to said opposite ends of said grid bars in a manner such that angular motion of said second pivot shaft about its longitudinal axis is accompanied by movement of said opposite ends of said grid bars; and means for imparting angular movement to said second pivot shaft independently of the other pivot shaft to independently adjust the positions of the two ends of said grid bars.

11. An extraction arm for a fiber bale opening machine according to claim 9, additionally comprising means for imparting angular movements to said second pivot shaft simultaneously with and equal to the angular movements imparted to the other pivot shaft to simultaneously adjust the positions of the two ends of said grid bars.

12. An extraction arm for fiber bale opening machine of the type which includes an adjustable grid for contacting a surface of the bale while tufts of fiber are being pulled form the bale for processing, said extraction arm including frame means; first and second pivot shafts mounted in spaced apart parallel relation to one another on said frame means for rotary movement about their longitudinal axes; a plurality of grid bars spaced apart from one another along the lengths of said pivot shafts and extending lengthwise across the space between said pivot shafts; first eccentric bush means fixed on said first pivot shaft; a plurality of first links rotatable about said first bush means; means pivotally connecting a first end of each of said grid bars to an end of one of said first links opposite to the end which is rotatable about said first eccentric bush means; second eccentric bush means fixed on said second pivot shaft; a plurality of second links rotatable about said second bush means; means pivotally connecting a second end of each of said grid bars to an end of one of said second links opposite to the end which is rotatable about said second eccentric bush means; means for limiting movement of said grid bars in the direction of the lengths of such bars; and means for imparting rotary movement to said pivot shafts.

13. An extraction arm for a fiber bale opening machine of the type which includes an adjustable grid for contacting a surface of the bale while tufts of fiber are being pulled form the bale for processing, said extraction arm including frame means; first and second pivot shafts mounted in spaced apart parallel relation to one another on said frame means for rotary movement about their longitudinal axes; a plurality of grid bars spaced apart from one another along the lengths of said pivot shafts and extending lengthwise across the space between said pivot shafts; first eccentric bush means fixed on said first pivot shaft; a plurality of first links rotatable about said first bush means; means pivotally connecting a first end of each of said grid bars o an end of one of said first links opposite to the end which is rotatable about said first eccentric bush means; second eccentric bush means fixed on said second pivot shaft; a plurality of second links rotatable about said second bush means; means pivotally connecting a second end of each of said grid bars to an end of one of said second links opposite to the end which is rotatable about said second eccentric bush means; means for limiting movement of said grid bars in the direction of the lengths of such bars; and means for imparting rotary movement to said pivot shafts; said first eccentric bush means being adjustable about the axis of said first pivot shaft and said second eccentric bush means being adjustable about the axis of said second pivot shaft.

14. An extraction arm for a fiber bale opening machine of the type which includes an adjustable grid for contacting a surface of the bale while tufts of fiber are being pulled form the bale for processing, said extraction arm including frame means; first and second pivot shafts mounted in spaced apart parallel relation to one another on said frame means for rotary movement about their longitudinal axes; a plurality of grid bars spaced apart from one another along the lengths of said pivot shafts and extending lengthwise across the space between said pivot shafts; a plurality of first eccentric bushings fixed on said first pivot shaft; a plurality of first links rotatable about said first bushings means pivotally connecting a first end of each of said grid bars to an end of one of said first links opposite to the end which is rotatable about said first eccentric bushing; a plurality of second eccentric bushings fixed on said second pivot shaft; a plurality of second links rotatable about said second bushings; means pivotally connecting a second end of each of said grid bars o an end of one of said second links opposite to the end which is rotatable about said second eccentric bushings; means for limiting movement of said grid bars in the direction of the lengths of such bars; and means for imparting rotary movement to said pivot shafts; means for independently adjusting the angular positions of said first and second pivot shafts; said means connecting said grid bars to said first links including a first pivot spindle; said means connecting said grid bars to said second links including a second pivot spindle; and said means for limiting movement of said grid bars including frame walls having vertically extending slots therein for receiving end portions of said first and second pivot spindles and permitting vertical adjustment of the ends of said grid bars; said slots being wider than said pivot spindles to permit some endwise movement of said grid bars upon unequal movements of said first and second links.

15. An extraction arm for a fiber bale opening machine according to claim 14, wherein said first and second pivot shafts are spaced farther apart horizontally and are located at a higher level than said first and second pivot spindles.

16. An extraction arm for a fiber bale opening machine according to claim 14, wherein said grid bars have enlarged end portions provided with bores therethrough for receiving said pivot spindles, the widths of said enlarged end portions in the direction of the bore axes being such that, when the end portions of all said of grid bars are disposed in abutting relation on said spindles, the central portions of said grid bars will be spaced apart from one another.

17. In a cotton bale opener comprising an extraction arm and means for moving said arm back and forth along a path extending adjacent a plurality of bales of fiber to pull tufts of fiber from said bales, said extraction arm including a grid made up of spaced apart grid bars for pressing against the bales and fiber engaging instrumentalities projectable through the spaces between grid bars for drawing tufts of fibes through the grid; the improvement comprising means for steplessly adjusting said grid to vary the amount of projection of said fiber engaging instrumentalities through said grid over a range of about ten millimeters, including extraction arm frame means, first and second parallel pivot shafts mounted on said frame means for rotary movement about their longitudinal axes, and means operatively connected to the ends of said grid bars and to said pivot shafts in a manner such that angular motion of said pivot shafts about their longitudinal axes is accompanied by movement of said grid bars to adjust the positions of said grid bars relative to said frame means to vary the amount of projection of said fiber engaging instrumentalities through said grid.

18. Apparatus as set forth in claim 17, including motor means operatively connected to said pivot shafts for adjusting the angular positions of said shafts.

19. Apparatus as set forth in claim 18, including a control system connected to said motor means for operating said motor means to adjust the angular positions of said pivot shafts and alter the amount of projection of said fiber engaging instrumentalities through said grid when more densely packed fiber levels are reached in interior portions of the bales.

* * * * *